United States Patent [19]

Ott et al.

[11] Patent Number: 4,604,843

[45] Date of Patent: Aug. 12, 1986

[54] LOST-FORM CONCRETE FALSEWORK

[75] Inventors: Renaud P. L. Ott, Saint Laurent Du Pont; Georges E. P. Jalabert, Saint Ismier, both of France

[73] Assignee: Societe Anonyme Dite "Etablissements Paturle", Saint Laurent Du Pont, France

[21] Appl. No.: 577,959

[22] Filed: Feb. 8, 1984

[30] Foreign Application Priority Data

Feb. 8, 1983 [FR] France ..... 83 02166
Sep. 28, 1983 [FR] France ..... 83 15742

[51] Int. Cl.[4] ..... E04B 1/00

[52] U.S. Cl. ..... 52/426; 52/309.9; 52/562; 52/309.12

[58] Field of Search ..... 52/426, 309.9, 309.12, 52/562, 564

[56] References Cited

U.S. PATENT DOCUMENTS

| | | | |
|---|---|---|---|
| 932,261 | 8/1909 | Flynn | 52/564 X |
| 2,029,082 | 1/1936 | Odam | 52/564 X |
| 2,141,397 | 12/1938 | Locke | 52/564 X |
| 2,447,670 | 8/1948 | Rumble | 52/564 X |
| 2,669,861 | 2/1954 | Clutter | 52/426 X |
| 3,902,296 | 9/1975 | Thomas | 52/426 X |
| 4,034,529 | 7/1977 | Lampus | 52/426 |
| 4,229,920 | 10/1980 | Lount | 52/426 X |
| 4,516,372 | 5/1985 | Grutsch | 52/426 X |

FOREIGN PATENT DOCUMENTS

| | | | |
|---|---|---|---|
| 146585 | 5/1952 | Australia | 52/562 |
| 486232 | 9/1974 | Australia | 52/426 |
| 1103549 | 3/1961 | Fed. Rep. of Germany | 52/426 |
| 335834 | 3/1959 | Switzerland | 52/562 |
| 571629 | 1/1976 | Switzerland | 52/562 |

*Primary Examiner*—J. Karl Bell
*Attorney, Agent, or Firm*—Karl F. Ross; Herbert Dubno

[57] ABSTRACT

A lost form for concrete which comprises insulting slabs of foam material reinforced by a core and held in place in an upright orientation by horizontal base elements, horizontal connecting elements disposed between the tiers of slabs and vertical elements bridging pairs of slabs of each tier. The horizontal elements have a ladder-like configuration with longitudinal members engaging in formations in the lower and upper edges of the slabs and transverse members extending horizontally between and spacing apart the slabs. The vertical elements also have a ladder-like configuration with vertical longitudinal members received in confronting grooves of the slabs and vertically spaced horizontal transverse members which bridge the slabs. The elements are retained in the cast concrete wall and hold the slabs thereagainst.

20 Claims, 22 Drawing Figures

FIG.1
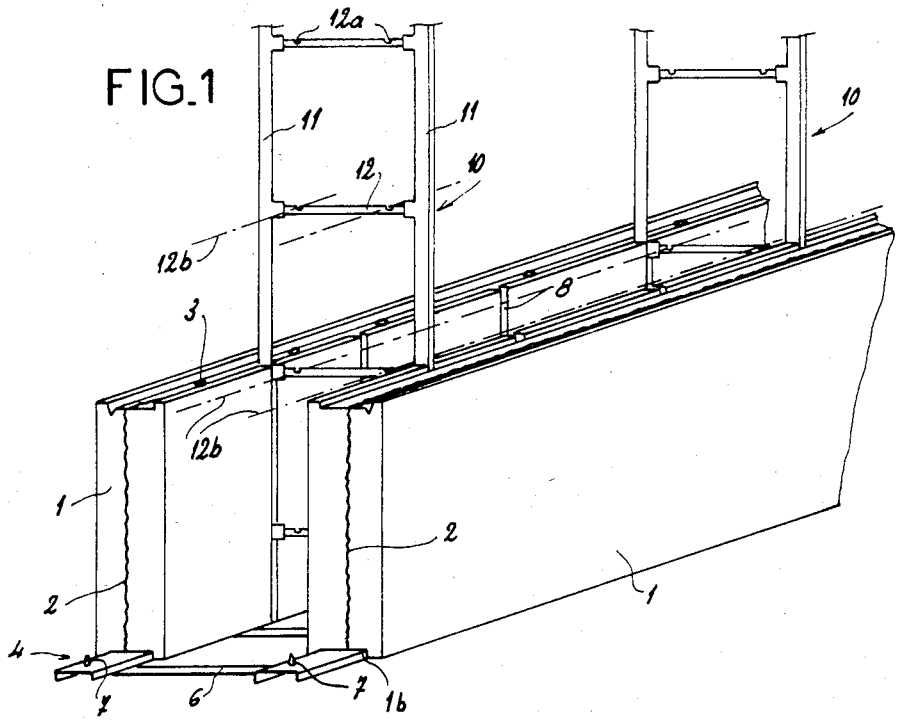
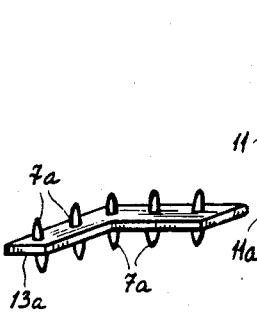
FIG.7A
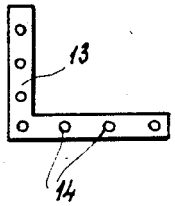
FIG.7
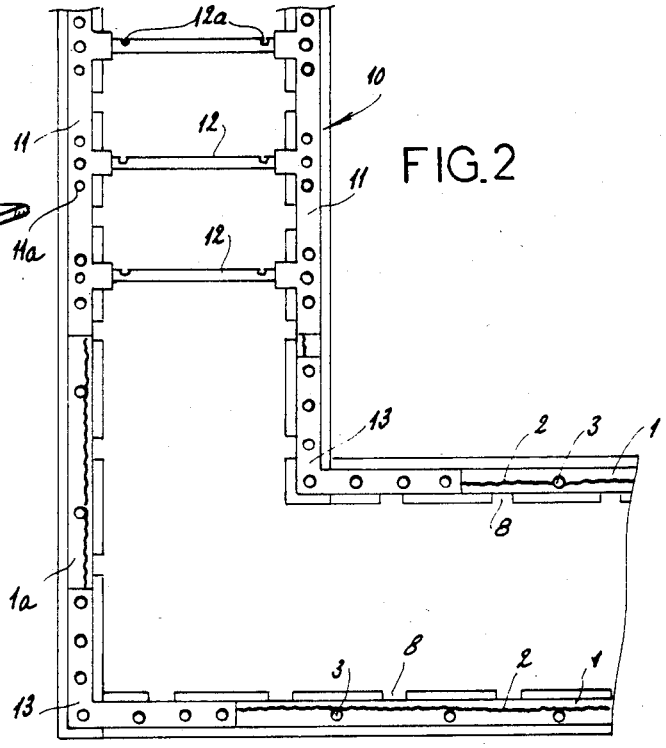
FIG.2

LOST-FORM CONCRETE FALSEWORK

FIELD OF THE INVENTION

Our present invention relates to a construction system utilizing so-called lost forms, i.e. a formwork for the casting of concrete made up of walls or panels which are left in place once the concrete hardens. In particular the invention deals with lost-form falsework and reinforcing structures, to concrete forms constituted by such falsework and the walls or other structures obtained from the casting of concrete therein.

BACKGROUND OF THE INVENTION

Structures such as buildings, public works and the like are frequently produced from concrete by casting the concrete into a space defined between two walls or surfaces and permitting the concrete to harden therein. The form is constituted by so-called falsework, i.e. a structure which does not itself constitute the final load-bearing member of the structure and such forms or falsework can be of two types, namely, removable forms which may or may not be reused or so-called lost forms which remain in place in the structure after the concrete has hardened.

Lost forms can include insulating members which by their presence on and in the hardened concrete structure, contribute thermal or insulating properties to the structure which may be a wall. Of course, the lost forms can contribute other properties, e.g. weatherproofing, esthetic characteristics or the like.

When the lost forms are to provide insulating characteristics, the material from which the forms are constituted can be composed of insulation or insulating material.

The lost forms which have been provided heretofore generally can also be divided into two categories, namely those constituted by planar solid slabs and those formed by hollow parallelopipedal blocks.

The large planar slab units have not gained widespread acceptance because their dimensions are determinitive of the dimensions of the structure to be cast and frequently it is not possible to employ these slabs conveniently in building or other structures. Furthermore, the use of such slabs is complicated by the need to employ connectors between the slabs which are difficult to emplace. Furthermore, they generally do not have sufficient insulating capabilities especially at the extremities of a wall to be formed by casting concrete into the lost mold.

The second type of lost form, namely that which is composed of hollow parallelopipedal blocks can be utilized for a greater range of structures because they are emplaced simply by disposing one block next to another and stacking rows of blocks in an imbricating pattern. Such arrangements can be adapted to various architectural plans and designs. Nevertheless they too pose considerable problems.

For example, once the wall is formed, the connections between the blocks are formed by insulating material tending to melt or to be thermally destroyed in the case of fire, leaving openings in the concrete wall. These horizontal "conduits" can be of considerable diameter and create the danger of airflow and thus of transmission of fire.

The angles at which the blocks join are comparatively weak and weaknesses occur as well at the junctions between rows of blocks, i.e. because the horizontal joints between the concrete constitute one wall and the concrete constituting an adjacent wall constitute discontinuities.

The volumes of the blocks, moreover, create problems with respect to their transport and transport costs because the ratio of volume-weight is considerable. As a consequence, even such lost forms have not gained widespread acceptance.

OBJECTS OF THE INVENTION

It is the principal object of the present invention to provide an improved lost-form construction system whereby advantages of both types of lost forms can be obtained without their respective disadvantages and which will obviate drawbacks of earlier systems.

Another object of this invention is to provide lost-form concrete molds for building and other structures which can be assembled quickly, which can be utilized to produce strong concrete structures, and which affords excellent insulating capabilities to the completed concrete wall structure.

SUMMARY OF THE INVENTION

These objects and others which will become apparent hereinafter are obtained in accordance with the present invention by providing insulating slabs which are interconnected by horizontal ladder-like connecting elements engaging the slabs and upon which the slabs are positioned to lie in vertical planes through the respective longitudinal members of these elements which are bridged by horizontally spaced transverse members thereof. These horizontal ladder-like elements are used to engage the slab edges adapted to rest upon the ground or foundation structure and to support the bottom edges of successively higher tiers of such slabs and in the latter case are fitted into grooves of the upper edges of underlying slabs. In addition, the slabs are bridged by vertical ladder-like connecting elements of a height greater than the height of the slabs so that each of these vertical ladder-like connecting elements extends across at least two and preferably a multiplicity of tiers of such slabs. In this case, the longitudinal members of the vertcal ladder-like elements are received in vertical grooves along the inner faces of the slabs of each tier and are bridged by transverse (horizontal) members which are vertically spaced apart. The vertical connecting elements and the transverse members of the horizontal connecting members can thus serve as reinforcements which are embedded in the concrete and reinforce the concrete wall while permanently retaining the insulating slabs thereagainst.

According to a feature of the invention, each of the slabs is constituted by cellular synthetic resin or plastic material and comprises a core which constitutes an internal reinforcement, the core being affixed to reinforcing tubes which can be spaced apart in mutually parallel relationship along the core and with the slab. Preferably these tubes extend vertically and open at the opposite horizontal edges of the slab to receive pins projecting from the ladder-like horizontal connecting element which joins this slab to the opposite slab of the respective tier.

Aligned slabs of a given tier can also be connected by plates having holes and disposed along these edges but transfixed by such pins as they pass from a horizontal connecting element into a respective overlying and/or underlying slab, and corners can be formed between slabs of a respective tier through the use of angles having such holes and lying along the upper and/or lower edge of the slab and likewise transfixed by such pins. Thus slabs of a given tier can adjoin orthogonally. Alternatively the angles can have pins engageable in the tubes.

The inwardly facing surfaces of the slabs can be provided with uniformly spaced vertical grooves with such grooves of the two confronting slabs of a given tier being aligned with one another so as to receive the longitudinal members of a respective vertical ladder-like connecting element.

Each horizontal ladder-like connecting element and each vertical connecting element can be interconnected at a common junction by an assembly formed from two mutually orthogonal elements including a horizontal element located above a vertical element, the two elements comprising means for locking them in their mutually orthogonal positions and being nestable such that the vertical element can lie within the horizontal element for transport and storage. These connecting elements can have the configuration of frames.

The ladder-like structures forming the vertical and/or horizontal connecting members described above may be assembled, in turn from frames and any girder-like cross section may be utilized in forming these members. The upper edges of the slabs with which these connecting elements are used may be provided with forms at a spacing corresponding to the dimensions of the frame structures to allow interfitting of projecting portions of the slabs and the ladder-like connecting elements.

BRIEF DESCRIPTION OF THE DRAWING

The above and other objects and features and advantages of the present invention will become more readily apparent from the following description, reference being made to the accompanying drawing in which:

FIG. 1 is a perspective view of a portion of a lost form according to one embodiment of the invention;

FIG. 2 is a plan view from above of a corner of the tier shown in FIG. 1 illustrating the connection between orthogonally adjoining slabs of this structure;

FIG. 7 is a plan view of an angle for forming the orthogonal joint shown in FIG. 2;

FIG. 7A is a perspective view of another angle which can be utilized in the formation of a junction between slabs of a tier;

SPECIFIC DESCRIPTION

The form slabs 1 are constituted by an insulating material having a strength sufficient to withstand the hydrostatic pressure of the concrete to be cast between the slabs. The slabs preferably are formed with a high density foamed synthetic resin such as expanded polystyrene, extruded polystyrene foam, polyurethane foam or a foamed phenolformadehyde or like resin.

Within the body of each slab, we can provide a reinforcing mesh, forming a reinforcing core and which can represent any conventional reinforcing or strengthening material. For example, it may be constituted by or include a layer or body of the same insulating material which is not foamed or expanded, i.e. a core of the insulating material but of its molecular density. The core may also be constituted by perforated or imperforated foil such as a reinforcing plate, or a perforated member of pressed wood. The core may also be flexible or yieldable, e.g. in the form of glass fibers or a fabric thereof, a grid of wires, rods or filaments which can be fused, interwoven or tied at the crossovers, a synthetic resin fabric or metallic or nonmetallic filaments.

The reinforcing core 2 is bonded to an array of mutually parallel tubes 3 which are embedded in the slab 1 and open along the upper and lower edge faces of the slab when the slab is positioned vertically as shown in FIG. 1.

These tubes can be composed of practically any material, e.g. metal, synthetic resin or plastic, glass fibers embedded in an epoxy resin or even cardboard or paper as long as they have a sufficient rigidity to enable them to receive the pins of connecting elements in a manner to be described below.

Figure 4:
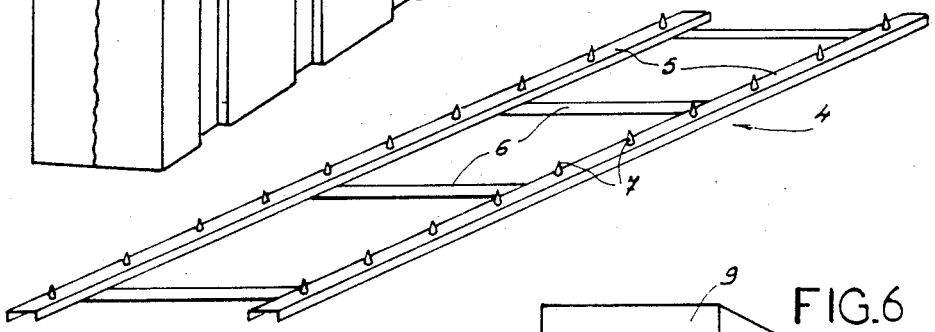
FIG. 4 is a perspective view of one of the ladder-like horizontal connecting elements.
Figure 6:
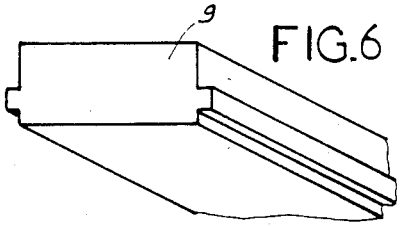
FIG. 6 is a perspective view of an end slab.
Figure 5:
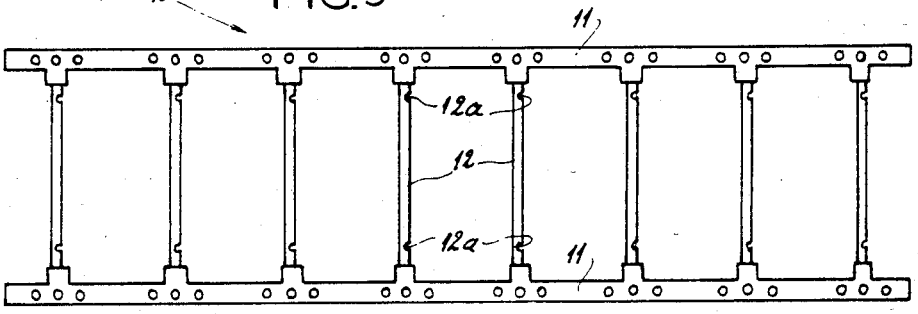
FIG. 5 is a plan view of a vertical ladder-like connecting element.
Figure 8:
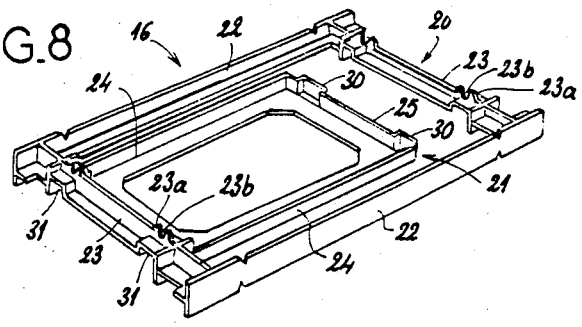
FIG. 8 is a perspective view of an embodiment of a reinforcing structure for a lost form according to the invention illustrating the folded position of the horizontal and vertical members.

The connecting elements which space the slabs apart in a given tier and can serve to connect each slab to the slabs of the next tier can be the horizontal ladder-like elements 4 best seen in FIGS. 1 and 4. Each of these horizontal elements comprises a pair of longitudinal members 5 interconnected by transverse members 6 which later may ultimately be embedded in the concrete cast between the slabs. The longitudinal members 5 are provided with pins 7 adapted to engage in the tubes 3 of the slabs 1 above and below the connecting element 4. In the embodiment shown, the pins only extend upwardly although it should be noted that similar pins can be provided to project downwardly to engage in an underlying slab of a lower tier. These elements 4 determine the spacing of the slabs of the tiers from one another.

The elements 4 forming the base for the lowest tier can be positioned upon and fixed to the ground or a foundation member or floor while the elements 4 disposed between the tiers are each disposed on the upper edge of a row of slabs of the preceding or lower tier so that the upstanding pins can engage in the tubes 3 of the overlying tier.

Figure 3:
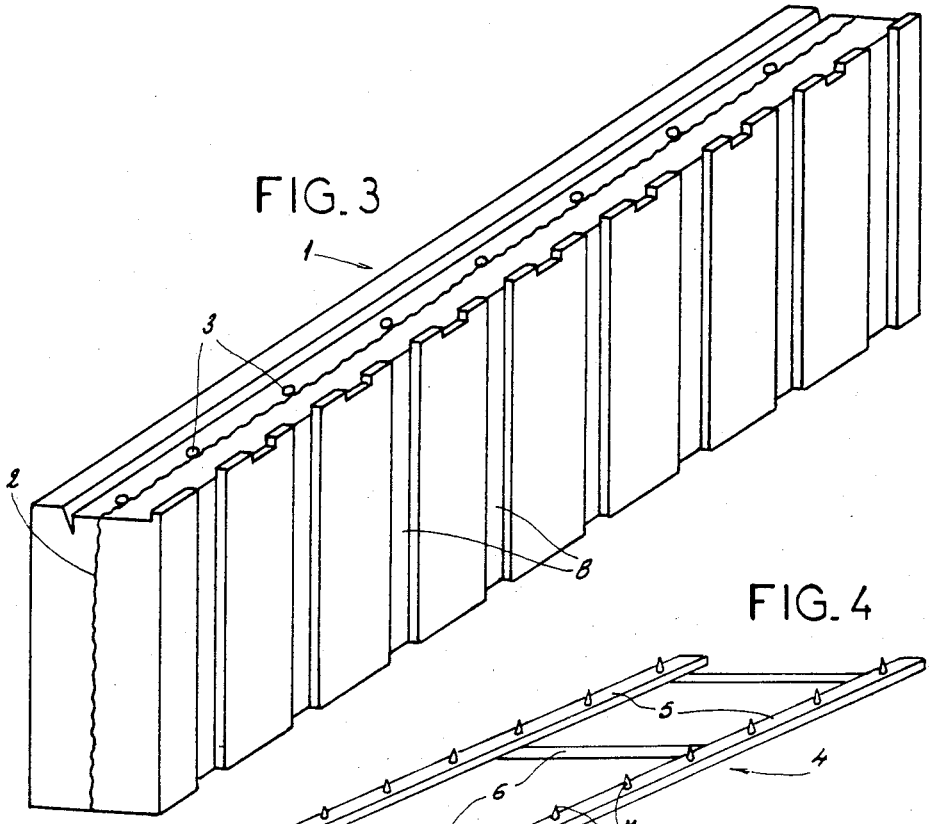
FIG. 3 is a perspective view of one of the slabs drawn to a larger scale and showing the inner surface.

Each slab 1 is formed along its inner surface (FIG. 3) with a multiplicity of parallel vertical grooves which are uniformly spaced along the length of the slab, i.e. are spaced apart in the longitudinal determination thereof. These grooves can receive either terminal plates 9 which can close a trough defined by the slabs 1 to constitute the mold or form for each tier, or vertical ladder-like connecting elements 10.

The vertical connecting elements 10 are each constituted with longitudinal members 11 which can have thicknesses or widths equal to the widths of the grooves 8 to fit snugly therein and transverse members 12 which interconnect the longitudinal elements.

Each of the transverse members 12 is provided with notches 12*a* along its upper surface to receive reinforcing bars 12*b* shown diagrammatically in FIG. 7 and adapted to be imbedded in the concrete which is cast in the trough once it is formed. The notches 12*a* are located at a fixed distance from each of the slabs 1 as will be apparent in FIG. 1. From FIG. 2 it will be apparent further that the horizontal members can also be notched to allow the positioning of vertical reinforcing bars in the assembly if desired, and that the same elements 10 which are utilized as vertical connecting elements can be utilized as horizontal connecting elements. The members 11 can be formed with pins 11*a* in regular spacing corresponding to a spacing of the bores 14 of angles 13 to facilitate connection of the slabs in the manner to be described.

The vertical elements 10, as can be seen from FIG. 1, can have a length greater than the height of a slab and preferably greater than the height of a plurality of slabs so that a plurality of bars of slabs can be interconnected by them.

As noted, another accessory which is utilized in the system of the invention is the angle 13. The angles 13 can be utilized to connect angularly adjoining slabs of a given tier by laying each angle in the adjoining recesses 1*a* and 1*b* of the upper and lower edges of the slab so that at least one hole 14 of each leg of the angle registers with at least one tube of each of the two angularly adjoining slabs. Then when a pin 7 from a connecting element 4 or similar pins on a connecting element 10 or pins which can be separately provided are inserted through the holes 14 into the tubes 3, the assemblies of slabs and angles are rigidly fixed in a static sense.

Of course, as indicated in FIG. 7A, the angles 13*a* may be used, these angles being provided with pins 7*a* extending upwardly and downwardly for engagement in the tubes 3 of overlying and underlying slabs, respectivly. In this case, holes of members 11 (instead of pins thereof) can also be placed over or under the angles 13*a* for greater rigidity when the members 10 are utilized as horizontal connecting elements.

Thus, to assemble the form utilizing these elements of the invention, the connecting element 2 is affixed to an appropriate base and the slabs 1 are fitted over this element by aligning the respective tubes with the pins 7 and placing the slabs over the longitudinal members 5 so that with these longitudinal members are snugly received in the groups 1*b* on the underside of each upright slab. The ends of the mold are closed by members 9 and the corners are formed utilizing the angles 13 or 13*a* in the manner described.

Another row of horizontal connecting elements 4 or 10 is then applied along the upper edges of the slabs 1 of the first tier and in the groove 1*a* thereof. In addition, the vertical connecting elements 10 are inserted into the grooves 8 of the juxtaposed slabs at appropriate horizontally spaced locations and a second row of slabs can be applied, preferably in an imbrecating pattern with respect to the first row. Casting of concrete can be commenced after emplacement of the reinforcing rods 12*b* and the successive tiers can be applied as concrete casting continuance. This limits the hydrostatic force which must be sustained by the lowermost elements. When the concrete is set, the elements 4 and 10 remain in place within the concrete as additional reinforcement and firmly retain via the pins 7 and 7*a* and the engagement of the elements in the respective grooves of the slabs, the slabs along the faces of the concrete structure to provide insulating surfaces thereof.

While embodiment of FIGS. 1–8 and 7A provides comparatively long ladder-like elements which can be utilized interchangeably and which are uniform in construction along their lengths, the ladder-like elements which are utilized in the embodiments of FIGS. 8–21 utilize different constructions for the element 15 (FIG. 10) adapted to space apart the slabs at the base and the element 16 (FIGS. 8 and 9) serving as elements of rigidification and as spacing elements above the base.

The spacers 15 of the base are each constituted in the form of a frame having two longitudinal members 17 and two transverse members 18. The members 17 are of angle cross section so that they have horizontal flanges 17*a* which can be fixed to the slab or foundation member provided on the ground. Their vertical flanges 17*b* are dimensioned to penetrate into longitudinal grooves formed in the lower edge surface of each slab (see FIG. 13).

The transverse members 18 of each base element 15 each have two zones of a hook shape set off upwardly and close to the ends of these members..

Each transverse member 18, moreover, has a projecting edge portion along its upper edge, two such projections being provided such that each projection flanks a notch 18*b* in which a metal reinforcing bar or the like can be received. The notches are asymmetrical and are defined laterally by a boundry which is substantially on the side of the notch proximal to a respective slab and by a flank which is inclined on the other side enabling the positioning of the reinforcement, regardless of its diameter at a constant distance from the proximal slab.

When each of the frame structures 15 is provided along the base of the slabs they collectively form a ladder-like array which functions in the manner described for the connecting element 4 previously.

The other connecting elements 16 of this embodiment of the invention comprise two frame members represented generally at 20 and 21, each of which can be formed by a pair of longitudinal members and a pair of transverse members.

The frame element 20, for example, is provided with longitudinal members 22 and transverse members 23. The frame elements 21 have longitudinal members 24 and transverse members 25. The two frame elements 20 and 21 can be articulated to one another at a junction between the transverse members 23 of one frame element and 25 of the other.

Each transverse member 23 has a salient portion **23*a* in which a notch 23*b* is provided with a configuration similar to the notch 18*b*** to receive reinforcing bars.

Figure 9:
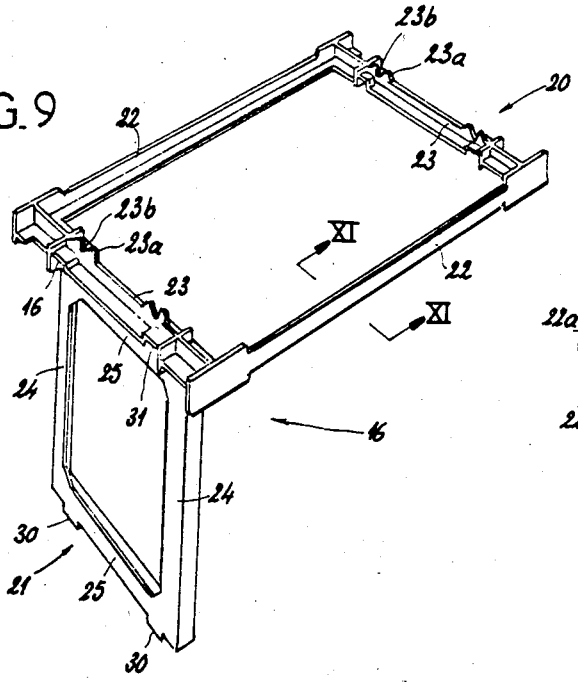
FIG. 9 is a perspective view of the unfolded assembly with its vertical and horizontal frame members before it is inserted into the lost form.
Figure 10:
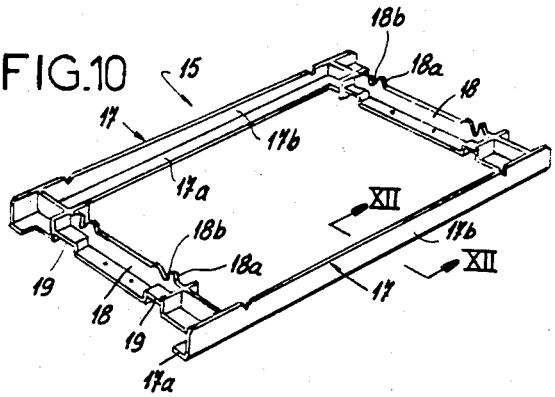
FIG. 10 is a perspective view of a spacer element according to this embodiment of the invention where individual frame members form the ladder-like connecting element, the element of FIG. 10 being utilized to horizontally space the slabs.

While the articulation can be constituted in a convenient manner, it should be noted that it is intended to permit the smaller element 21 to be received in the larger element 20 for storage, transportation or handling (FIG. 8) but to allow the frame elements that lie at right angles to one another as shown in FIG. 9 so that the frame elements 20 can form part of a horizontal ladder array while the frame elements 21 form part of a vertical ladder array (see FIG. 13) upon assembly.

To this end, hook formations 30 which are complementary to and are engageable by the hook formations 31 (similar to the hook formations 19) can be provided.

In the position of use the transverse member 25 while hooking into engagement with one of the transverse members 18, 23 is also positioned so that it locks the reinforcing bars **23*c* in the notches 18*b*, 23*b*** in place.

Figure 11:
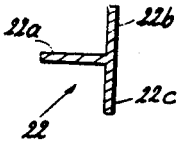
FIG. 11 is a section taken along the line XI—XI of FIG. 9.
Figure 12:
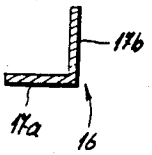
FIG. 12 is a section taken along the line XII—XII of FIG. 10.

The longitudinal members 22 of element 20 which is utilized in a horizontal position, have a T cross section as shown in FIG. 11 so that the horizontal flange **22*a* can lie in a recessed zone 26 of a lower edge surface of a slab 1 while the vertical flanges 22*b* and 22*c* project into grooves 27 formed in upper and lower edge faces of the slabs 1 to be joined by this element in respective tiers. For best interfitting connection of the adjoining edge faces of the tiers of slabs, the upper edge surfaces have plugs 28 which fit snugly into complementary recesses 29** formed in the lower edge surfaces. In the embodiment illustrated, these plugs and recesses are of square configuration and are regularly spaced along the slabs.

Each element 21 has a width which is smaller than that of the element 20 to enable it to be received in the space flanked by the slabs 1. The longitudinal members 24 can have an L cross section (FIG. 12) or a channel cross section while the transverse members 25 at the extremities of the element 21 have the zones 30 which are in the form of hooks or clips enabling them to cooperate with the hooks 19 of the traverse 18 of the base spacer 15 and to abut the horizontal reinforcing bars.

The transverse members 23 of element 20 also have two hook-shaped zones 31 identical to the regions 19 of the base elements 15. As a result, each element 21 can cooperate both with the base element 15 therebelow and with an assembly 16 thereabove in similar fashion.

Figure 13:
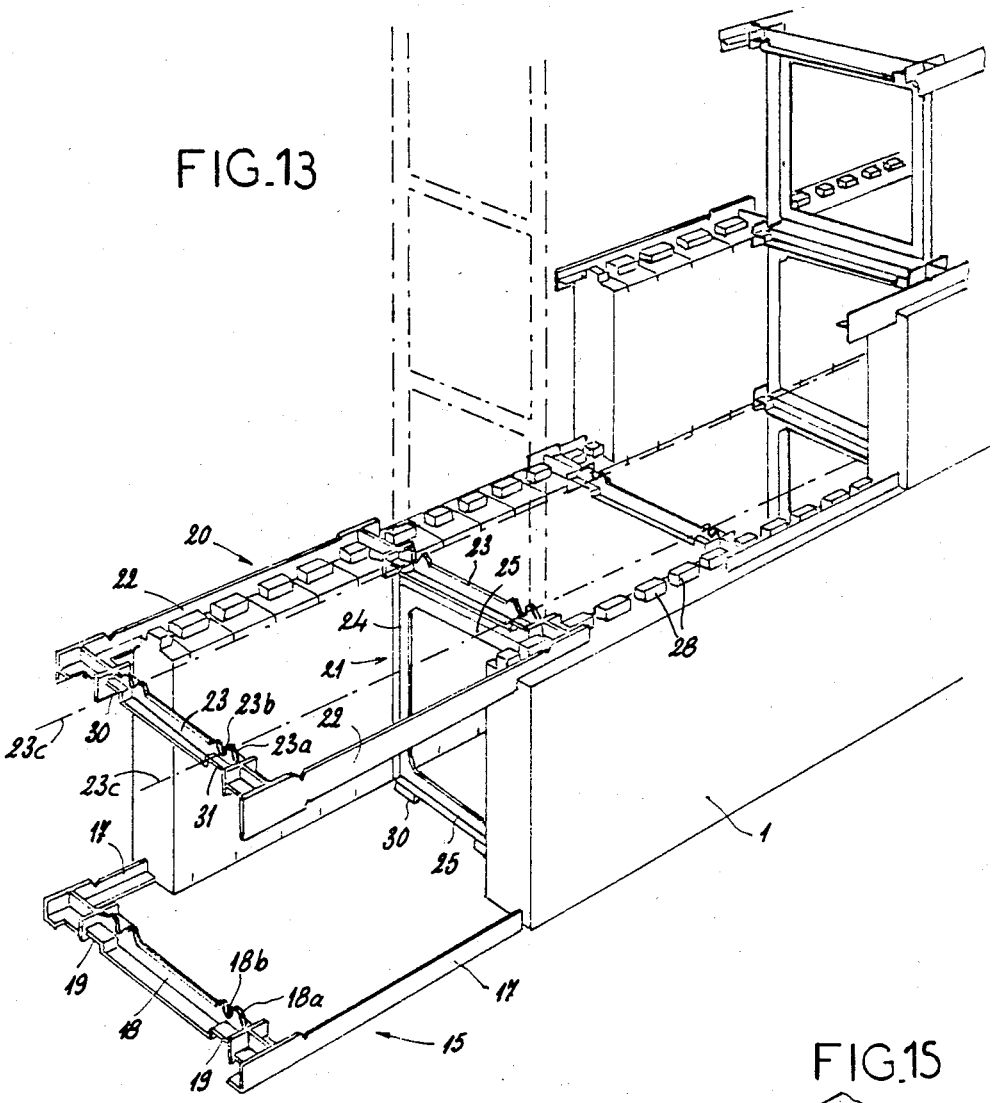
FIG. 13 is a view similar to FIG. 1 illustrating the lost form utilizing the frame members as the ladder-like connecting elements.
Figure 14:
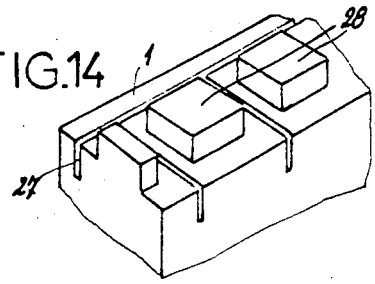
FIG. 14 is a detail view of the formations at the upper edge of an insulating slab of the invention.
Figure 15:
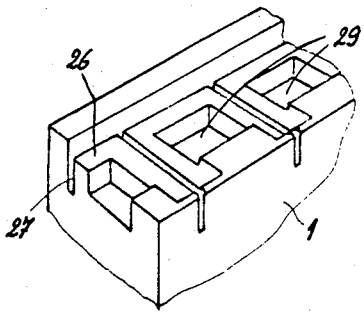
FIG. 15 is a detail view as seen from below of the lower edge of an adjoining slab according to the invention.

As a consequence, the assembly 16 is positioned as shown in FIG. 13 defining ladder-like arrays which can extend full height and length in lost a form or mold as may be required, the assemblies 16 being contiguous or spaced apart and providing both the requisite rigidity and interlocking of the entire structure of slabs, reinforcing assemblies, reinforcing bars and the like. The key to this interlocking relationship, of course, is the cooperation of each vertical frame unit 21 of an assembly 16 with a horizontal frame unit rigid with a pair of slabs which are spaced apart by it.

Frame elements 21 of the type shown at 21 also can be used conveniently for the fabrication of a lintel.

Figure 16:
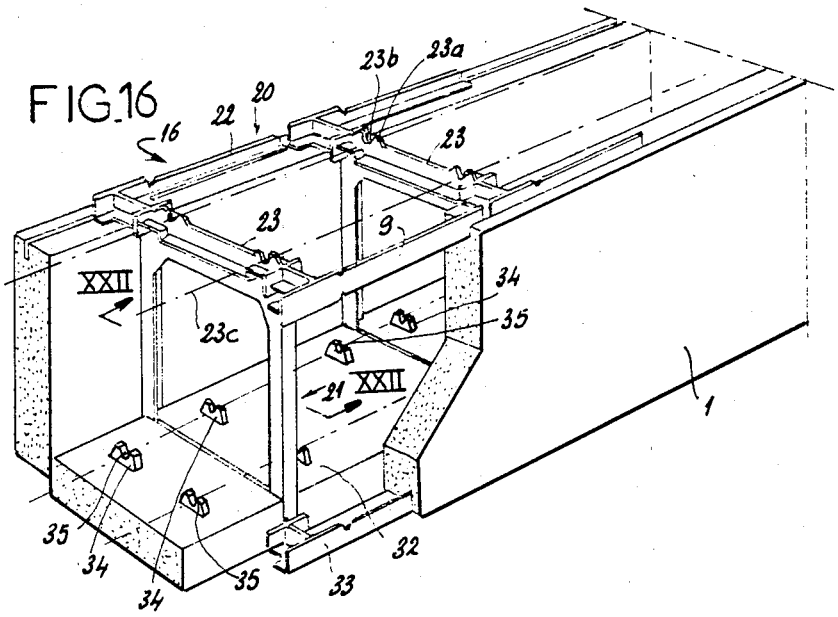
FIG. 16 is a perspective view of a portion of a lost form in a zone of a structure in which the resulting body is intended to form a lintel.
Figure 17:
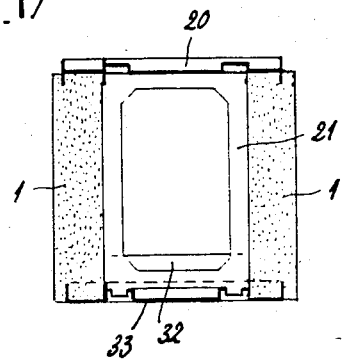
FIG. 17 is a section along the line XVII—XVII of FIG. 16.
Figure 18:
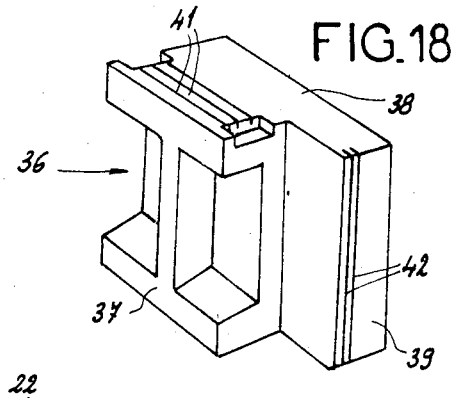
FIG. 18 is a perspective view of an end plate for closing off one end of the lost form.
Figure 19:
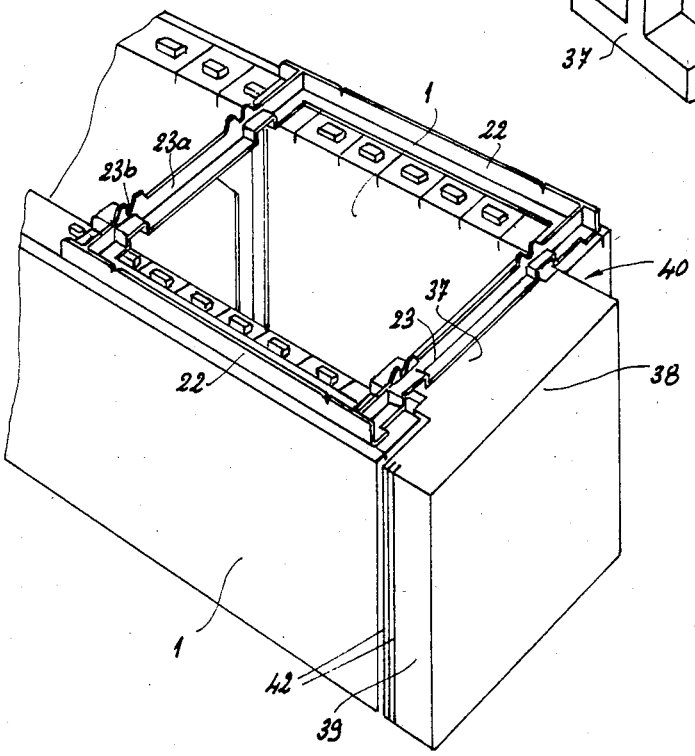
FIG. 19 is a perspective view of a closed lost form utilizing the member of FIG. 18.

As shown in FIGS. 16 and 17, the panels or slabs 1 are provided in addition to closure panels or slabs 32 which can be mounted on elements 33 identical to the connecting elements 15 previously described. The elements 33 have transverse members which engage the hooks formed on the lower transverse members of the elements 21 of assemblies 16 rigid with the slabs 1. The closure panels 32 also comprise projections 34 which have notches 35 adapted to receive reinforcing bars for the reinforcement of the lintel. The ends of the mold at the regions of the openings in the wall which are to be formed, namely, windows and doorways, are closed with slabs 36 which can be structurally identical to the slabs 1 in the sense that they may be composed of cellular synthetic resins provided with a reinforcing core, etc. The closure at the end of the mold has been represented in FIG. 19 and the slab or end plate 36 has been shown in greater detail in FIG. 18. The end plate 36 has a part 37 which projects into the space between two slabs 1 and thus engages between the confronting faces of these slabs 1. A further part 38 can project laterally of the inner fitting part 37 to lie flush with one of the slabs 1 and define a rabbet 40 in which a window frame, door frame or like structure can be received. To permit adjustment of the opening accommodating the frame, the plate 36 can be driven in or inserted to a greater or lesser extent between the slabs 1.

Figure 20:
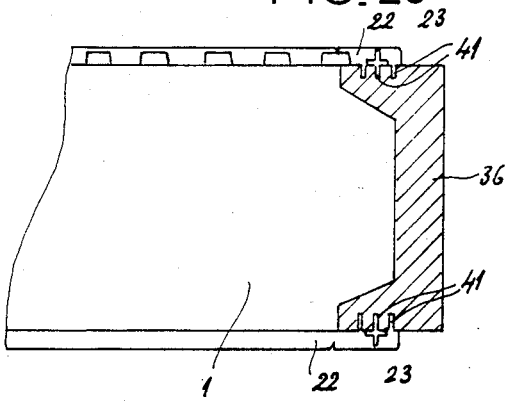
FIG. 20 is a longitudinal section through a vertical plane of the assembly of FIG. 19.

We can provide, for example, a plurality of parallel longitudinal grooves 41 which can be selectively engaged by the transverse members 18, 23 of the elements 15, 20. Thus depending upon the groove 41 which is thus engaged, the part 37 of the plate 36 can be held more or less deeply in the mold. FIG. 20 shows a plate 36 having three grooves 41, the transverse member 18, 23 engaging in the middle groove. In order to insure a flush connection for the part 29 which lies against the end of a slab 1, grooves 42 can be provided to show lines along which materials can be removed from this projection portion for the various depths of insertion of the part 37. These parts can be cut away by a simple construction knife or blade because of the softness of the foam material, or by a saw.

Figure 21:
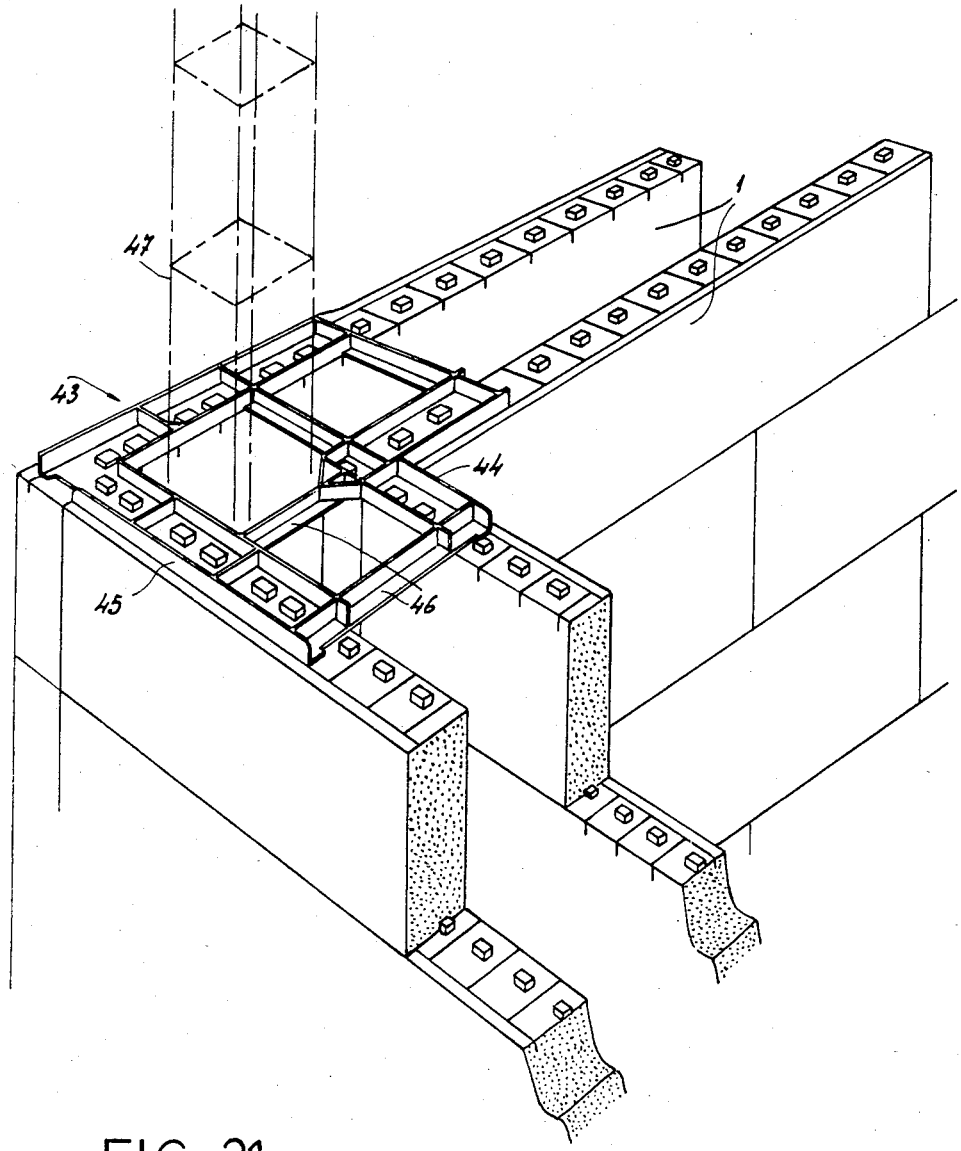
FIG. 21 is a perspective view of a corner of a lost form according to another embodiment of the invention.

FIG. 21 shows a corner of a mold constructed with several tiers and in which a corner member 43 is provided to hold the assembly together. In this case, the piece 43 forms a passage through which an assembly of vertical reinforcing rods 47 can extend as a columnar reinforcement and ladder arrays project along each of the walls of the column, members 44 and 45 representing longitudinal members of the connecting element while members 46 represent the transverse members thereof. Otherwise the element 43 functions in the manner previously described with respect to the other connecting elements as to how it can engage the slabs.

We claim:

1. A lost concrete form comprising:

a multiplicity of slabs adapted to remain in place subsequent to the casting of concrete in the form and including at least two slabs in horizontally spaced upright orientation in at least one tier; and a plurality of rigid ladder-like connecting elements each having a pair of longitudinal members each resting upon an upper edge of a respective one of said slabs, said longitudinal members and said upper edges of said slabs having mutually engaging formations anchoring said longitudinal members to slabs, each ladder-like connecting element further having a plurality of mutually parallel transverse members bridging said longitudinal members and rigidly connected thereto, spanning between said slabs and anchored in the concrete upon the casting thereof between said slabs whereby said connecting elements retain said slabs on the concrete structure resulting from the hardening of concrete cast between said slabs.

2. The lost concrete form defined in claim 1 wherein said elements include at least one substantially horizontal element having horizontal longitudinal members and at least one vertical element having vertical longitudinal members and horizontal transverse members.

3. The lost concrete form defined in claim 2 wherein each of said slabs is composed of a cellular synthetic resin and is formed with a reinforcing core rigid with a multiplicity of reinforcing tubes embedded in said slab and opening along upper and lower longitudinal edges of said slab, the longitudinal members of said horizontal element being provided with pins engageable in said tubes along a respective one of said edges.

4. The lost concrete form defined in claim 3 wherein the slabs connected by said elements angularly adjoin other such slabs adapted to form a corner junction, further comprising angles having pins engageable in said tubes for connecting the angularly adjoining slabs.

5. The lost concrete form defined in claim 2 wherein said slabs are provided on confronting faces with horizontally spaced vertical grooves said vertical members being received in said grooves.

6. The lost concrete form defined in claim 5, further comprising an end slab bridging the first mentioned slabs at an end of said form and received in grooves of said first mentioned slabs.

7. The lost concrete form defined in claim 2 wherein said vertical and horizontal elements form an assembly provided with means for connecting them together at a right angle.

8. The lost concrete form defined in claim 7 wherein said elements are frames.

9. The lost concrete form defined in claim 7 wherein said elements are independent of one another but are provided with means for interconnecting them.

10. The lost concrete form defined in claim 7 wherein said assembly is provided with means for fixing same to said slabs.

11. The lost concrete form defined in claim 7 wherein the longitudinal members of said horizontal element are of T section and have vertical flanges received respectively in longitudinal grooves of a lower slab and an upper slab juxtaposed with one another in forming respective tiers of the mold, said longitudinal members of said horizontal element having horizontal flanges recessed in one of the superposed slabs.

12. The lost concrete form defined in claim 7 wherein each of said elements has one of its transverse members articulated on a transverse member of the other of said elements.

13. The lost concrete form defined in claim 7 wherein the horizontal element is longer than the vertical element and comprises a plurality of transverse members on which vertical elements are articulated.

14. The lost concrete form defined in claim 7 wherein the elements of said assembly are fixed orthogonally to one another in an inverted L or T configuration, the connection between the vertical element of the assembly and the horizontal element being affected by simple elastic deformation by the vertical element of the horizontal element.

15. The lost concrete form defined in claim 7 wherein a multiplicity of said assemblies are disposed contiguously along said slabs.

16. The lost concrete form defined in claim 7 wherein said assemblies are spaced apart from one another along said slabs.

17. The lost concrete form defined in claim 2 wherein at least some of said transverse members are formed with notches adapted to receive reinforcing bars.

18. The lost concrete form defined in claim 17 wherein said vertical elements are formed with means for retaining reinforcing bars in upwardly turned notches of transverse members of underlying horizontal elements.

19. The lost concrete form defined in claim 2, further comprises an end plate at least partly receivable between said slabs and having a projecting portion lying flush with an outer face of one of said slabs, said plate being provided with grooves selectively engageable by a respective one of said elements for retaining said plate relative to said slabs, said projecting portion being provided with grooves enabling the selective assembly of material to adjust the depth of penetration of said plate between said slabs.

20. The lost concrete form defined in claim 2 wherein said horizontal element has an L shape and is adapted to be received in a corner of the form to hold angularly adjoining slabs in position with respect to one another.

* * * * *